US005469791A

United States Patent [19]

Theurer et al.

[11] Patent Number: 5,469,791

[45] Date of Patent: Nov. 28, 1995

[54] MOBILE MACHINE FOR PREPARING RAILS FOR WELDING

[75] Inventors: Josef Theurer, Vienna; Herbert Wörgötter, Gallneukirchen, both of Austria

[73] Assignee: Franz Plasser Bahnbaumaschinen-Industriegesellschaft, Vienna, Austria

[21] Appl. No.: 303,087

[22] Filed: Sep. 8, 1994

[30] Foreign Application Priority Data

Sep. 17, 1993 [AT] Austria ..... A1889/93

[51] Int. Cl.[6] ..... E01B 27/00

[52] U.S. Cl. ..... 104/5; 104/2; 104/7.1; 104/15

[58] Field of Search ..... 104/2, 3, 5, 7.1, 104/7.2, 15

[56] References Cited

U.S. PATENT DOCUMENTS

| | | | |
|---|---|---|---|
| 4,236,453 | 12/1980 | Cöllen . | |
| 4,249,467 | 2/1981 | Theurer et al. | 104/3 |
| 4,272,664 | 6/1981 | Theurer . | |
| 4,502,389 | 3/1985 | Theurer et al. | 104/2 |
| 4,571,825 | 2/1986 | Skibsted | 104/2 |
| 4,911,599 | 3/1990 | Theurer et al. | 104/5 |

FOREIGN PATENT DOCUMENTS

| | | | |
|---|---|---|---|
| 0800880 | 9/1958 | United Kingdom | 104/2 |
| 0805075 | 11/1958 | United Kingdom | 104/2 |
| 2036141 | 6/1980 | United Kingdom | 104/2 |
| 3030473 | 3/1982 | United Kingdom | 104/2 |

*Primary Examiner*—Mark T. Le
*Attorney, Agent, or Firm*—Collard & Roe

[57] ABSTRACT

A mobile machine for preparing rails for welding comprises an elongated bridge-like machine frame extending in a longitudinal direction, the machine frame having an upwardly recessed frame portion extending between opposite ends of the machine frame and defining a work space, and undercarriages support the opposite machine frame ends. Rail lifting devices are mounted on the machine frame for displacement in the longitudinal direction, and drives vertically adjust the rail lifting devices. The machine further has support shelves for storing rails on the machine frame.

10 Claims, 2 Drawing Sheets

MOBILE MACHINE FOR PREPARING RAILS FOR WELDING

BACKGROUND OF THE INVENTION

1. Field of the Invention

The present invention relates to a mobile machine for preparing rails for welding.

2. Description of the Prior Art

U.S. Pat. Nos. 4,236,453 and 4,272,664 disclose mobile rail welding machines which carry a rail welding device and other tools in a work space between undercarriages supporting opposite ends of the machine frame.

SUMMARY OF THE INVENTION

It is a primary object of this invention to provide a machine for preparing rails for welding and, more particularly, for optimally preparing supplemental rail pieces to be welded into track rails.

The above and other objects are accomplished according to the invention with a mobile machine which comprises an elongated bridge-like machine frame extending in a longitudinal direction, the machine frame having an upwardly recessed frame portion extending between opposite ends of the machine frame and defining a work space, undercarriages supporting the opposite machine frame ends, rail lifting means mounted on the machine frame for displacement in the longitudinal direction, drive means for vertically adjusting the rail lifting means, and means for supporting rails on the machine frame.

Without requiring time-consuming and labor-intensive retrofitting work, such a machine makes it possible very quickly and fully to prepare rails for welding. For example, a worn switch tongue may be readily lifted off the track by the lifting means of the machine and may be supported on the machine, after which a new switch tongue that has been transported on the machine may be placed on the track and properly positioned for welding. Optimal positioning of the lifting means and of the rail piece to be welded may be accomplished by moving the machine along the track and/or by moving the lifting means on the machine frame. The machine frame of such a machine, in fact, provides a frame bridging over the welding gap in which the new rail piece is placed and welded to the track rail. It has the additional advantage that other tools used in the welding operation may be mounted in the work space to enable the work to proceed rapidly.

According to a preferred embodiment, the rail lifting means comprises a crane supported by undercarriages for displacement in the longitudinal direction, the crane comprising a vertically and transversely adjustable boom, the machine frame is comprised of two carrier beams extending parallel to each other in the longitudinal direction and being transversely spaced from each other, and guide rails extend atop the machine frame in the longitudinal direction, the guide rails supporting the undercarriages of the crane. This enables large and heavy rail pieces to be transported quickly and without problems within the work space to facilitate the removal and storing of worn rail pieces as well as the correct positioning of new rail pieces for rapid welding.

Similar advantages are obtained with rail lifting means which comprises a plurality of hoists spaced from each other in the longitudinal direction, the drive means comprises an independent drive for each one of the hoists, and further comprising a respective horizontally and transversely extending guide rail for each one of the hoists, each guide rail displaceably mounting each hoist in the work space underneath the machine frame. It is particularly useful if the rail lifting means comprises the crane and the hoists.

The guide rails for the hoists are preferably mounted on an underside of the machine frame for displacement in the longitudinal direction and are displaceable independently of each other, and fixing devices hold the guide rails in a selected position. This will much improve a versatile use of the hoists.

According to another preferred embodiment, the machine frame is comprised of two carrier beams extending parallel to each other in the longitudinal direction and being transversely spaced from each other, and the means for supporting the rails on the machine frame comprises a plurality of carrier arms spaced from each other in the longitudinal direction, extending perpendicularly thereto and affixed to the carrier beams, each carrier arm having a free end spaced from the carrier beam whereto it is affixed and a horizontally extending face for supporting the rails. The carrier arms are positioned at side faces of the carrier beams facing each other, and the free carrier arm ends are spaced from each other in a direction extending perpendicularly to the longitudinal direction by a distance corresponding to at least half the gage of the undercarriages supporting the opposite machine frame ends. Particularly in conjunction with a crane, this makes the positioning of the new rail piece on the track for welding and the storing of the worn rail piece on the carrier arms very simple and easy.

In accordance with yet another preferred embodiment, the machine frame is comprised of two carrier beams extending parallel to each other in the longitudinal direction and being transversely spaced from each other, an operator's cab is mounted at one of the machine frame ends, access steps lead from the cab to the work space between the carrier beams for enabling an operator to reach the work space from the cab and to leave the work space through the cab, and a boundary means extends in the longitudinal direction below each carrier beam for securing the work space within the gage. In this case, the guide rail for each hoist extends horizontally and transversely inside the boundary means, each guide rail displaceably mounts each hoist in the work space underneath the machine frame. Preferably, the carrier beams have undersides spaced about two meters from ties of a track on which the undercarriages of the machine frame are supported. With a minimal additional structure, this substantially increases the safety of the operating personnel so that train traffic may continue on a neighboring track while the welding operation proceeds.

The machine may further comprise an operator's cab mounted at one of the machine frame ends, a loading platform at the opposite machine frame end, the loading platform being at a lower level than the upwardly recessed frame portion, and wherein the rail lifting means comprises a crane supported by undercarriages for displacement in the longitudinal direction, and guide rails atop the machine frame extending in the longitudinal direction above the loading platform, the guide rails supporting the undercarriages of the crane. This embodiment makes it possible to transport small machines, such as spike or screw driving machines, on the loading platform, which may be moved into operating position by the crane.

BRIEF DESCRIPTION OF THE DRAWING

The above objects, features and advantages of the present invention will become more apparent from the following detailed description of now preferred embodiments thereof, taken in conjunction with the accompanying, partly schematic drawing wherein.

DETAILED DESCRIPTION OF PREFERRED EMBODIMENT

Figure 1:
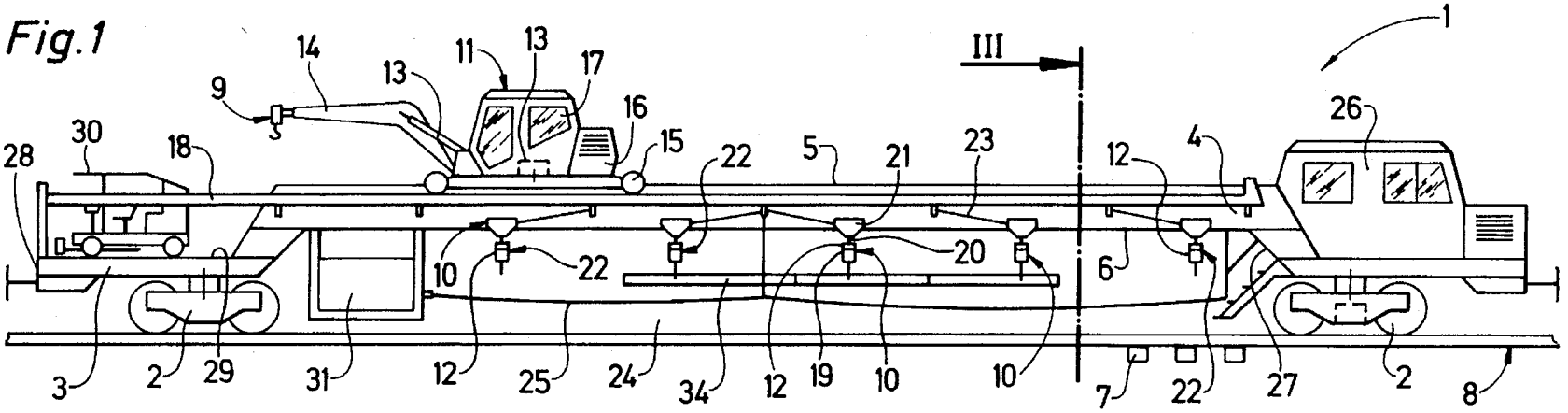
FIG. 1 is a side elevational view of a machine for preparing rails for welding according to this invention.

Referring now to the drawing, there is shown mobile machine 1 for preparing rails 34 for welding. The machine comprises elongated bridge-like machine frame 3 extending in a longitudinal direction and having upwardly recessed frame portion 4 extending between opposite ends of machine frame 3. The upwardly recessed frame portion defines work space 24 within the gage of undercarriages 2 supporting the opposite machine frame ends. Rail lifting means 9, 10 are mounted on machine frame 3 for displacement in the longitudinal direction, and drive means 13, 19 enable the rail lifting means to be vertically adjusted. Means 33 support rails 34 on the machine frame.

Figure 2:
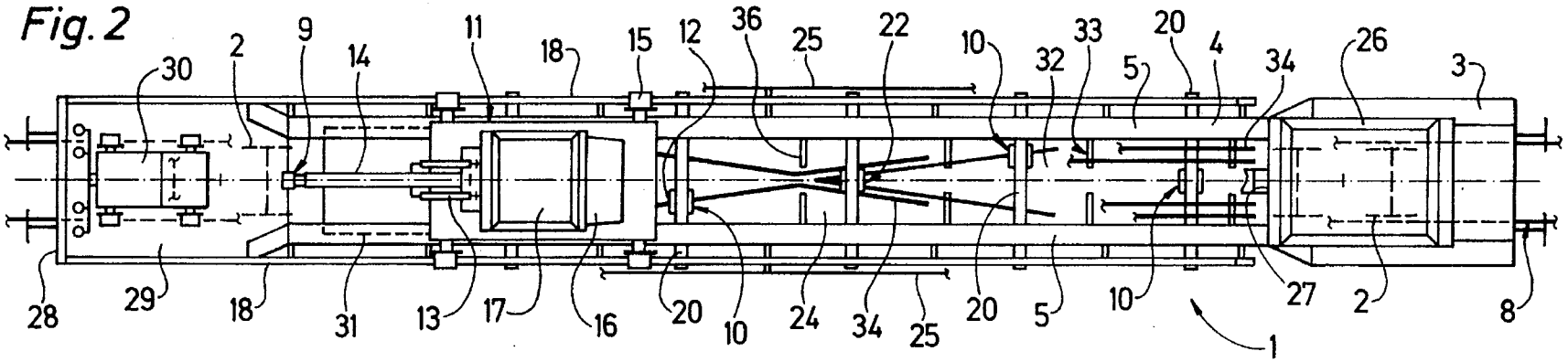
FIG. 2 is a top view of the machine of FIG. 1.
Figure 3:
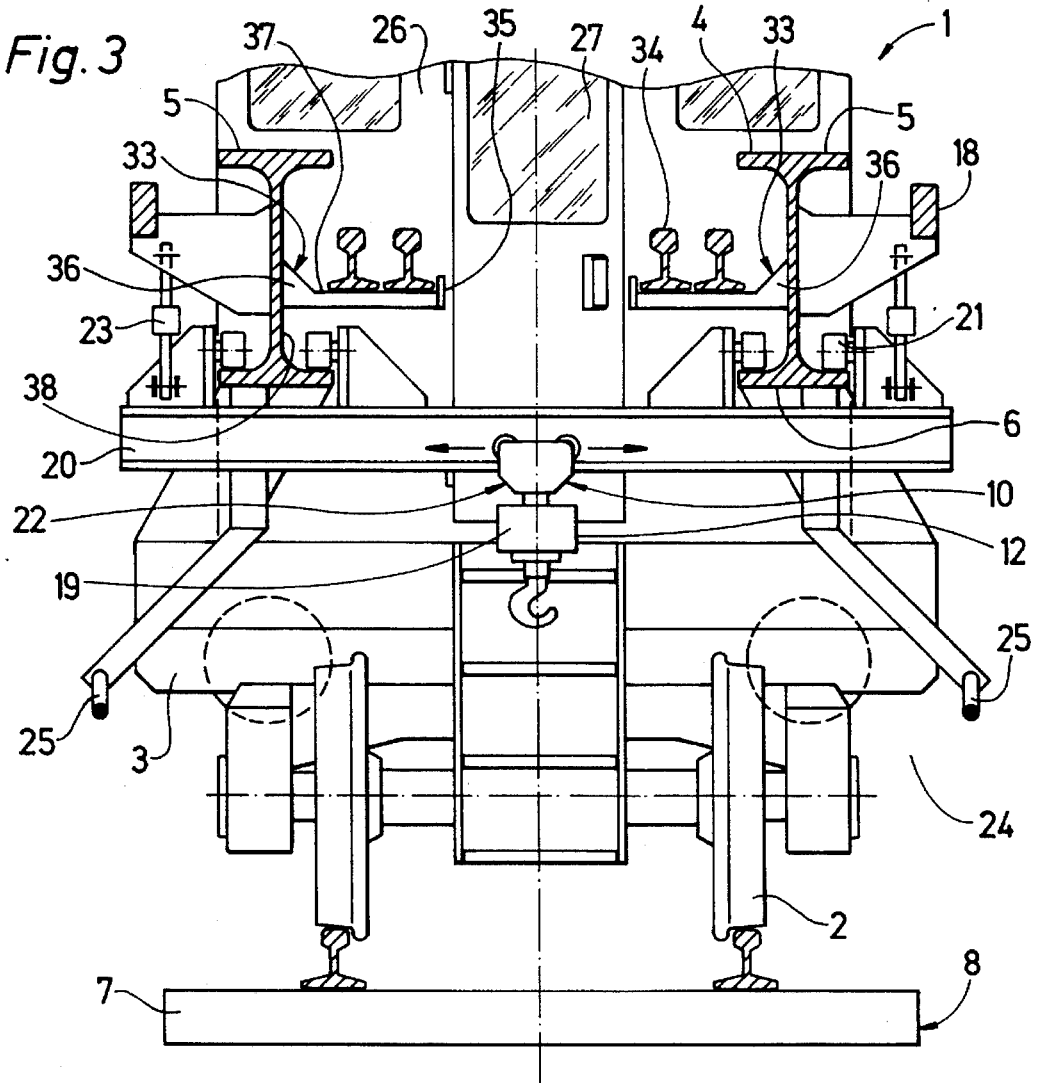
FIG. 3 is an enlarged transverse section of the machine along line III of FIG. 1.

As shown, rail lifting means 9 is a crane 11 supported by undercarriages 15 for displacement in the longitudinal direction and comprising vertically and transversely adjustable boom 14 carrying a lifting hook, and the machine frame is comprised of two carrier beams 5 extending parallel to each other in the longitudinal direction and being transversely spaced from each other (see FIG. 2). As shown in FIG. 2, carrier beams 5 define therebetween an open gap 32 wherethrough crane boom 14 may be lowered into work space 24. The illustrated carrier beams are I-beams, as illustrated in FIG. 3. Guide rails 18 extend atop the machine frame in the longitudinal direction and support undercarriages 15 of crane 11 for displacement of lifting means 9 in the longitudinal direction. The crane is propelled by motor 16 and carries operator's cab 17. Boom 14 of crane 11 is vertically and transversely adjustable by drives 13. The carrier beams have undersides spaced about two meters from ties 7 of track 8 on which undercarriages 2 of machine frame 2 are supported for mobility of machine 1 along the track.

Rail lifting means 10 is comprised of a plurality of hoists 22 spaced from each other in the longitudinal direction, and the drive means comprises an independent drive 19 for each hoist, for example a tackle 12. Other suitable hoists may be used instead of tackles. A respective guide rail 20 for each hoist 22 extends horizontally and transversely, each guide rail displaceably mounting each hoist in the work space underneath machine frame 2. Each guide rail 20 for hoist 22 is mounted on an underside of machine frame 2 for displacement in the longitudinal direction, running on rollers 21 along carrier beams 5, as best shown in FIG. 3. Guide rails 20 for hoists 22 are displaceable independently of each other, and fixing devices 23 hold the guide rails in a selected position.

As shown in FIGS. 2 and 3, means 33 for supporting rails 34 on machine frame 2 comprises a plurality of carrier arms 36 spaced from each other in the longitudinal direction, extending perpendicularly thereto and affixed to carrier beams 5. Each carrier arm has a free end 35 spaced from the carrier beam whereto it is affixed and a horizontally extending face 37 for supporting rails 34. The carrier arms are positioned at side faces of the carrier beams facing each other, and free carrier arm ends 35 are spaced from each other in a direction extending perpendicularly to the longitudinal direction by a distance corresponding to at least half the gage of undercarriages 2 supporting the opposite machine frame ends.

The machine further comprises operator's cab 26 mounted at one of the machine frame ends, access steps 27 leading from the cab to work space 24 between carrier beams 5 for enabling an operator to reach the work space from cab 26 and to leave the work space through the cab, and boundary means 25 extending in the longitudinal direction below each carrier beam for securing the work space within the gage of track 8. Guide rails 20 for hoists 22 extend inside the boundary means below machine frame 2. The boundary means may be longitudinally extending ropes transversely spaced from each other by a distance corresponding roughly to the length of ties 7. This assures safe access to work space 24 directly through cab 26.

As shown in FIGS. 1 and 2, machine 1 further comprises loading platform 29 at machine frame end 28 opposite the end carrying cab 26, the loading platform being at a lower level than upwardly recessed frame portion 4, and guide rails 18 atop machine frame 2 extend in the longitudinal direction above the loading platform to machine frame end 28. As schematically indicated in the drawing, loading platform 29 supports a spike or screw driving machine 30 between guide rails 18, and this auxiliary machine may be lifted by crane 11 off the loading platform and onto track 8 for mobility thereon. A tool box 31 is affixed to the underside of machine frame 2 for carrying such tools, as rail cutters and the like, needed for the welding operation.

Figure 4:
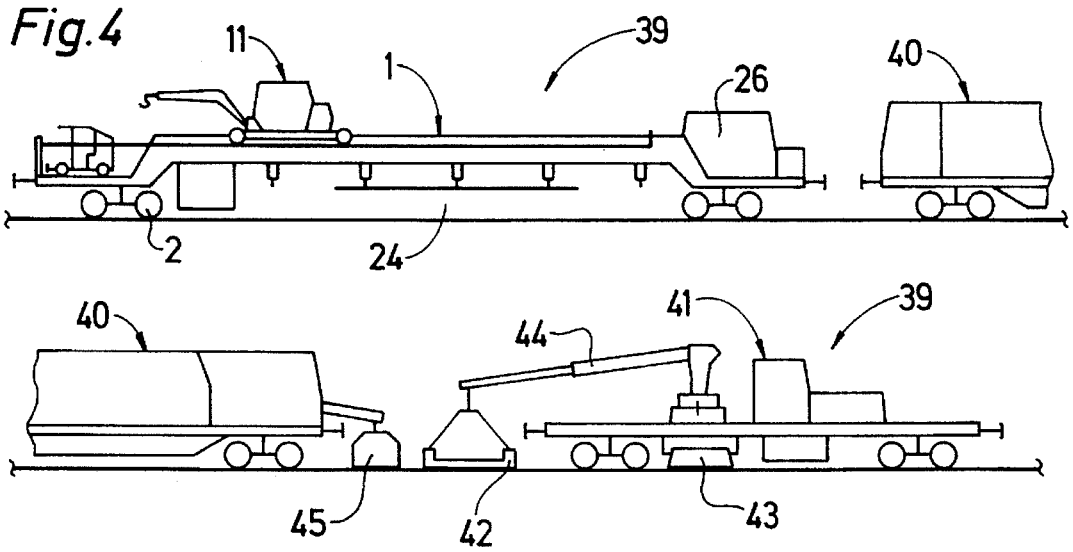
FIG. 4 is a schematic side elevational view of an installation for preparing rails for welding and for welding them, comprised of a plurality of mobile machines.

Installation 29 shown in FIG. 4 is comprised of machine 1 for preparing rails for welding, an independently movable welding machine 40 carrying a flash butt welding device 45, and a further independently movable work car 41. The work car carries an annular rail tensioning device 42 used in conjunction with welding device 45, as well as rail grinding device 43. Rail tensioning device 42 is carried by boom 44 of a crane for positioning the device in an operating position around flash butt welding device 45.

The operation of machine 1 will be described hereinbelow and proceeds as follows:

Before machine 1 is moved to the welding site, replacement rails 34 are securely stored on carrier arms 36 of means 33 for supporting the rails to be welded. When ready for operation, the machine is so positioned on track 8 that upwardly recessed machine frame portion 4 extends above the operating site. Subsequently, a rail piece to be replaced, for example a frog of switch tongue, is severed from the track, fixing devices 23 are detached from guide rails 20 of hoists 22 and the hoists are moved into an optimal position for lifting the severed rail piece off the track. Drives 19 are then operated to lift the rail piece attached to the hoists, and the hoists are transversely displaced along guide rails 20 to move the lifted rail piece to the opposite track shoulder. If desired, crane 11 may be used in conjunction with hoists 22 in this operation. After the worn rail piece has been removed, the replacement rail piece, for instance a frog, stored on carrier arms 36 is grasped by boom 14 of crane 11 and transported through opening 32 between carrier beams 5 to the vacated gap in the track to replace the worn piece. Proper maneuvering of the hoists 22 enables the replacement rail piece to be positioned accurately for the succeeding welding operation.

During the entire operation, the workmen are safely housed between ropes 25 in work space 24 under machine frame 2, and they can enter and exit the work space through cab 26 by access steps 27 without ever being exposed to danger from traffic along a neighboring track. This also permits access to cab 17 on crane 11. It may be useful to make cab 26 large enough for use as a dining and rest room for the workmen to enhance their safety during the entire work day.

The worn rail piece is positioned on the track shoulder by hoists 22 so that it may be readily grasped by crane boom 14 and transported through opening 32 on carrier arms 36. If machine 30 is needed to fasten the newly welded rail piece on ties 7, crane 11 may be used to transport the same to the work site. For this purpose, the crane is moved along guide rails 18 to machine frame end 28, the machine is grasped by the crane and is then placed on track 8. The longitudinal and transverse displacement of hoists 22 enables every site along track 8 within work space 24 to be reached without any problem. The same holds true for crane 11 which is movable in a longitudinal direction and whose boom 14 is adjustable transversely so that it may also reach to the track shoulders.

After the new rail piece, such as a frog, has been properly placed in the track, it is provisionally shackled to the track, and machine 1 is moved away. Welding machine 40 and work car 41 are then moved into position and flash butt welding device 45 in cooperation with rail tensioning device 42 are operated to weld the new rail piece to the track. If desired, rail grinding device 43 may then be used to remove any weld beads.

What is claimed is:

1. A mobile machine for preparing rails for welding, which comprises (a) an elongated bridge-like machine frame extending in a longitudinal direction, the machine frame having
  (1) an upwardly recessed frame portion extending between opposite ends of the machine frame and defining a work space, and being comprised of
  (2) two carrier beams extending parallel to each other in the longitudinal direction and being transversely spaced from each other, (b) undercarriages supporting the opposite machine frame ends, (c) rail lifting means mounted on the machine frame for displacement in the longitudinal direction, (d) drive means for vertically adjusting the rail lifting means, (e) means for supporting rails on the machine frame, (f) an operator's cab mounted at one of the machine frame ends, (g) access steps leading from the cab to the work space between the carrier beams for enabling an operator to reach the work space from the cab and to leave the work space through the cab, and (h) a boundary means extending in the longitudinal direction below each carrier beam for securing the work space within the gage.

2. The machine of claim 1, wherein the rail lifting means comprises a crane supported by undercarriages for displacement in the longitudinal direction, the crane comprising a vertically and transversely adjustable boom, and further comprising guide rails atop the machine frame and extending in the longitudinal direction, the guide rails supporting the undercarriages of the crane.

3. The machine of claim 1, wherein the rail lifting means comprises a plurality of hoists spaced from each other in the longitudinal direction, the drive means comprises an independent drive for each one of the hoists, and further comprising a respective horizontally and transversely extending guide rail for each one of the hoists, each guide rail displaceably mounting each hoist in the work space underneath the machine frame.

4. The machine of claim 3, wherein the guide rails for the hoists are mounted on an underside of the machine frame for displacement in the longitudinal direction.

5. The machine of claim 4, wherein the guide rails for the hoists are displaceable independently of each other, and further comprising fixing devices for holding the guide rails in a selected position.

6. The machine of claim 1, wherein the means for supporting the rails on the machine frame comprises a plurality of carrier arms spaced from each other in the longitudinal direction, extending perpendicularly thereto and affixed to the carrier beams, each carrier arm having a free end spaced from the carrier beam whereto it is affixed and a horizontally extending face for supporting the rails.

7. The machine of claim 6, wherein the carrier arms are positioned at side faces of the carrier beams facing each other.

8. The machine of claim 7, wherein the free carrier arm ends are spaced from each other in a direction extending perpendicularly to the longitudinal direction by a distance corresponding to at least half the gage of the undercarriages supporting the opposite machine frame ends.

9. The machine of claim 1, wherein the carrier beams have undersides spaced about two meters from ties of a track on which the undercarriages of the machine frame are supported.

10. A mobile machine for preparing rails for welding, which comprises (a) an elongated bridge-like machine frame extending in a longitudinal direction, the machine frame having
  (1) an upwardly recessed frame portion extending between opposite ends of the machine frame and defining a work space, (b) undercarriages supporting the opposite machine frame ends, (c) rail lifting means mounted on the machine frame for displacement in the longitudinal direction,
  (1) the rail lifting means comprising a crane supported by undercarriages for displacement in the longitudinal direction, (d) drive means for vertically adjusting the rail lifting means, (e) means for supporting rails on the machine frame, (f) an operator's cab mounted at one of the machine frame ends, (g) a loading platform at the opposite machine frame end, the loading platform being at a lower level than the upwardly recessed frame portion, and (h) guide rails atop the machine frame extending in the longitudinal direction above the loading platform, the guide rails supporting the undercarriages of the crane.

* * * * *